US008999432B2

(12) United States Patent
Tanaka et al.

(10) Patent No.: US 8,999,432 B2
(45) Date of Patent: Apr. 7, 2015

(54) CAP METAL FORMING METHOD

(75) Inventors: Takashi Tanaka, Yamanashi (JP); Yusuke Saito, Yamanashi (JP); Mitsuaki Iwashita, Yamanashi (JP)

(73) Assignee: Tokyo Electron Limited, Tokyo (JP)

( * ) Notice: Subject to any disclaimer, the term of this patent is extended or adjusted under 35 U.S.C. 154(b) by 1279 days.

(21) Appl. No.: 12/405,468

(22) Filed: Mar. 17, 2009

(65) Prior Publication Data

US 2010/0062159 A1 Mar. 11, 2010

(30) Foreign Application Priority Data

Sep. 11, 2008 (JP) ..... 2008-233528

(51) Int. Cl.

| | |
|---|---|
| ***B05D 5/12*** | (2006.01) |
| ***B05C 11/00*** | (2006.01) |
| ***B05B 13/04*** | (2006.01) |
| ***B05C 5/00*** | (2006.01) |
| ***C23C 18/38*** | (2006.01) |
| ***C23C 18/16*** | (2006.01) |

(52) U.S. Cl.

CPC ..... *C23C 18/38* (2013.01); *C23C 18/1632* (2013.01); *C23C 18/1678* (2013.01); *C23C 18/1682* (2013.01)

(58) Field of Classification Search

USPC ..... 427/58

See application file for complete search history.

(56) References Cited

U.S. PATENT DOCUMENTS

| | | | | |
|---|---|---|---|---|
| 2003/0051662 | A1* | 3/2003 | Lee et al. | 118/50 |
| 2004/0065540 | A1* | 4/2004 | Mayer et al. | 204/198 |
| 2004/0137161 | A1* | 7/2004 | Segawa et al. | 427/430.1 |
| 2008/0280437 | A1* | 11/2008 | Tanaka et al. | 438/678 |
| 2009/0162547 | A1* | 6/2009 | Sawada et al. | 427/240 |

FOREIGN PATENT DOCUMENTS

| | | | |
|---|---|---|---|
| JP | 11-288900 | A | 10/1999 |
| JP | 2003-129251 | A | 5/2003 |
| WO | 2006/081290 | A2 | 8/2006 |
| WO | WO 2007/069728 | * | 6/2007 |
| WO | WO 2008/001697 | * | 1/2008 |

* cited by examiner

*Primary Examiner* — Austin Murata
(74) *Attorney, Agent, or Firm* — Pearne & Gordon LLP

(57) ABSTRACT

A cap metal forming method capable of obtaining a uniform film thickness on the entire surface of a substrate is provided. A method for forming a cap metal on a processing surface of a substrate provided with two or more regions having different water-repellent properties, includes: holding the substrate horizontally by a rotatable holding mechanism installed in an inner chamber; supplying a gas between the inner chamber and an outer chamber covering the inner chamber via a gas supply hole provided in a top surface of the outer chamber; forming a pressure gradient between the inner chamber and the outer chamber; and supplying a plating solution to a preset position on the processing surface of the substrate after a pressure of the gas inside the inner chamber reaches a preset value so as to form the cap metal on at least one of the regions.

3 Claims, 10 Drawing Sheets

CAP METAL FORMING METHOD

FIELD OF THE INVENTION

The present disclosure relates to a cap metal forming method for forming a cap metal on a target substrate or the like by performing a liquid process such as plating or the like.

BACKGROUND OF THE INVENTION

In the design and manufacture of a semiconductor device, there has been an increasing demand for a higher operating speed and a higher level of integration. Meanwhile, it has been pointed out that electro-migration (EM) easily occurs due to a current density increase caused by a high-speed operation and wiring miniaturization, whereby wiring disconnection may be caused. This results in deterioration of reliability. For this reason, Cu (copper), Ag (silver) or the like having a low resistivity has been used as a wiring material formed on a substrate of the semiconductor device. Especially, since the copper has a resistivity of about 1.8 μΩ·cm and is expected to exhibit high EM tolerance, it is regarded as a material suitable for achieving the high speed of the semiconductor device.

In general, a damascene method has been utilized to form a copper wiring on the substrate, and this method involves forming a via and a trench on an insulating film by etching, and then filling them with a Cu wiring. Further, there has been made an attempt to enhance the EM tolerance of the semiconductor device by coating a metal film called a cap metal on the Cu wiring by electroless plating by means of supplying a plating solution containing CoWB (cobalt. tungsten.boron), CoWP (cobalt.tungsten.phosphorus), or the like on the surface of the substrate having the Cu wiring (see, for example, Patent Document 1).

The cap metal is formed by supplying the electroless plating solution on the surface of the substrate having the Cu wiring. For example, the substrate may be fixed on a rotary support, and by supplying the electroless plating solution while rotating the rotary support, a uniform liquid flow is generated on the substrate surface, whereby a uniform cap metal can be formed over the entire substrate surface (see, for example, Patent Document 2).

As for the electroless plating, however, it is known that a precipitation ratio of metal is largely affected by reaction conditions such as the composition and the temperature of the plating solution, and the like. Moreover, there has occurred a problem that by-products (residues) due to the plating reaction are generated in the form of slurry and remain on the substrate surface, impeding the uniform flow of the plating solution and making it impossible to replace the deteriorated electroless plating solution with new one. As a result, the reaction conditions on the substrate become locally different, making it difficult to form a cap metal having a uniform film thickness over the entire surface of the substrate. In addition, the substrate surface on which the cap metal is to be formed becomes to have a locally hydrophilic region or a locally hydrophobic region due to a difference in the surface material or sparseness or denseness of wiring. As a result, the electroless plating solution cannot be supplied onto the entire region of the substrate in a uniform manner, resulting in a failure of forming the cap metal having a uniform film thickness over the entire surface of the substrate.

Patent Document 1: Japanese Patent Laid-open Publication No. 2006-111938

Patent Document 2: Japanese Patent Laid-open Publication No. 2001-073157

BRIEF SUMMARY OF THE INVENTION

As stated above, the conventional plating method has a drawback in that the electroless plating solution cannot be uniformly supplied onto the entire surface of the substrate, thus making it difficult to obtain the uniform film thickness over the entire surface of the substrate.

In view of the foregoing, the present disclosure provides a cap metal forming method capable of reducing the amount of use of an electroless plating solution and also capable of forming a cap metal having a uniform film thickness over the entire surface of a substrate by suppressing influence of by-products generated by a plating reaction.

In accordance with an embodiment of the present disclosure, there is provided a method for forming a cap metal on a processing surface of a substrate provided with two or more regions having different water-repellent properties, the method including: holding the substrate horizontally by a rotatable holding mechanism installed in an inner chamber; supplying a gas between the inner chamber and an outer chamber covering the inner chamber via a gas supply hole provided in a top surface of the outer chamber; forming a pressure gradient between the inner chamber and the outer chamber; and supplying a plating solution to a preset position on the processing surface of the substrate after a pressure of the gas inside the inner chamber reaches a preset value so as to form the cap metal on at least one of the regions.

In the method for forming the cap metal, the region on which the cap metal is formed by the plating solution supplying step may be a copper pattern. Desirably, in the pressure gradient forming step, the gas may be introduced through a gas inlet opening provided at a sidewall of the inner chamber, and may be uniformly injected onto the processing surface of the substrate through a rectifying plate disposed above the processing surface of the substrate inside the inner chamber. It is desirable that in the pressure gradient forming step, a flow of the gas on the substrate toward a circumferential direction thereof may be generated by adjusting a gas exhaust amount by means of controlling a gas exhaust pump and a valve independently connected with the outer chamber or the inner chamber.

In accordance with the present disclosure, it is possible to achieve a formation of a uniform film thickness on a surface of a substrate.

BRIEF DESCRIPTION OF THE DRAWINGS

The disclosure may best be understood by reference to the following description taken in conjunction with the following figures.

DETAILED DESCRIPTION OF THE INVENTION

A general electroless plating process includes a pre-cleaning process, a plating process, a post-cleaning process, a rear surface/end surface cleaning process, and a drying process. Here, the pre-cleaning process is a process for hydrophilicizing a wafer to be processed. The plating process is a process for performing plating by supplying a plating solution onto the wafer. The post-cleaning process is a process for removing residues generated by a plating precipitation reaction. The rear surface/end surface cleaning process is a process for removing residues which are generated during the plating process on the rear surface and the end surface of the wafer. The drying process is a process for drying the wafer. Each of these processing steps is implemented by combining a rotation of the wafer, a supply of a cleaning solution or a plating solution onto the wafer, and so forth.

In the plating process in which a processing solution such as the plating solution is supplied onto the substrate, there may be generated a non-uniformity in the film thickness of a film (plated film) generated by the plating process due to a variation of a processing solution supply, or the like. Especially, in case that the target substrate has a large size, or Cu patterns having sparseness or denseness exist on the processing surface of a substrate on which an interlayer insulating film is formed, the variation of the film thickness becomes conspicuous. A semiconductor manufacturing apparatus in accordance with an embodiment of the present disclosure is designed to solve the problem of film thickness variation·non-uniformity especially in the plating process among each process of the electroless plating process for the substrate.

Figure 1:
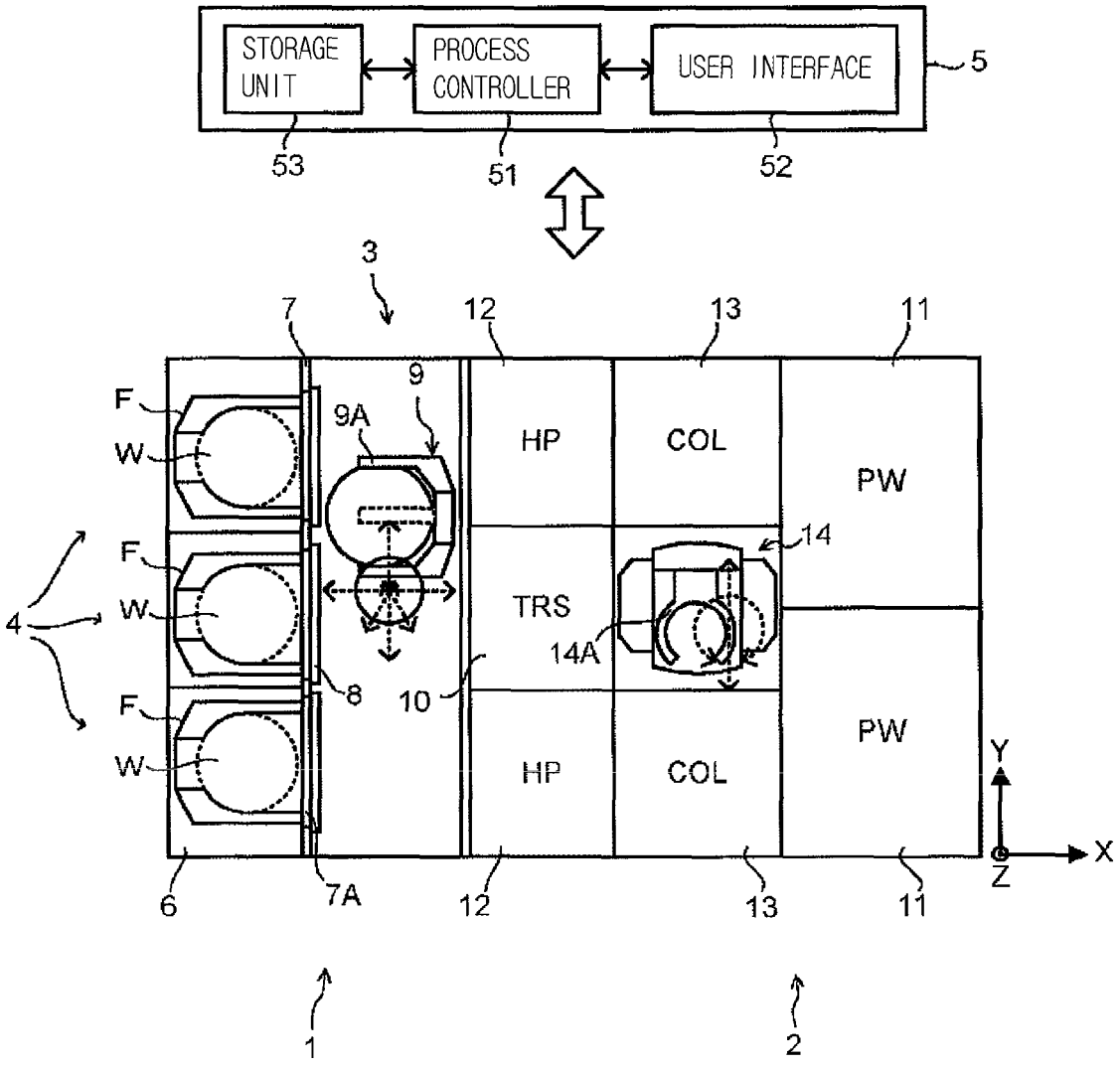
FIG. 1 provides a plane view illustrating a configuration of a semiconductor manufacturing apparatus in accordance with an embodiment of the present disclosure.

Hereinafter, the embodiment of the present disclosure will be described in detail with reference to the accompanying drawings. FIG. 1 is a plane view showing a configuration of the semiconductor manufacturing apparatus in accordance with the embodiment of the present disclosure, and FIGS. 2 and 3 set forth a cross sectional view and a plane view of an electroless plating unit of the semiconductor manufacturing apparatus in accordance with the embodiment of the present disclosure, respectively. FIG. 4 depicts a configuration view of a fluid supply device.

As shown in FIG. 1, the semiconductor manufacturing apparatus in accordance with the embodiment of the present disclosure includes a loading/unloading unit 1, a processing unit 2, a conveyance unit 3 and a control unit 5.

The loading/unloading unit 1 is a device for loading and unloading plural substrates W into and out of the semiconductor manufacturing apparatus via FOUPs (Front Opening Unified Pods) F. As shown in FIG. 1, the loading/unloading unit 1 includes three loading/unloading ports 4 arranged in Y direction along the front face (lateral side of X direction of FIG. 1) of the apparatus. Each loading/unloading port 4 has a mounting table 6 for mounting the FOUP F thereon. A partition wall 7 is formed on the rear surface of each gate loading/unloading port 4, and a window 7A corresponding to the FOUP F is formed at the partition wall 7 to be positioned above the mounting table 6. Each window 7A is provided with an opener 8 for opening or closing a lid of the FOUP F. The lid of the FOUP F is opened or closed by the opener 8.

The processing unit 2 is a group of processing units for performing each of the above-described processes on the substrates W sheet by sheet. The processing unit 2 includes a transfer unit TRS 10 for performing a transfer of the substrate W with respect to the conveyance unit 3; electroless plating units PW 11 for performing an electroless plating process and pre- and post-processes therefor on the substrate W; heating units HP 12 for heating the substrate W before and after the plating process; cooling units COL 13 for cooling the substrate W heated by the heating units 12; and a second substrate transfer mechanism 14 disposed in a substantially center portion of the processing unit 2 while being surrounded by the group of these units and serving to transfer the substrate W between the respective units.

The transfer unit 10 includes substrate transfer devices (not shown) vertically arranged in two levels, for example. The upper and lower substrate transfer devices can be used complementarily depending on the purposes of use. For example, the lower substrate transfer device may be used to temporarily mount thereon the substrate W loaded from the loading/unloading port 4, while the upper substrate transfer device may be used to temporarily mount thereon the substrate W to be unloaded back into the loading/unloading port 4.

The two heating units 12 are disposed at locations adjacent to the transfer unit 10 along the Y direction. Each heating unit 12 includes, for example, heating plates vertically arranged in four levels. The two cooling units 13 are disposed at locations adjacent to the second substrate transfer mechanism 14 in the Y direction. Each cooling unit 13 includes, for example, cooling plates vertically arranged in four levels. The two electroless plating units 11 are arranged in the Y direction along the cooling units 13 and the second substrate transfer mechanism 14 located adjacent to them.

The second substrate transfer mechanism 14 includes, for example, two transfer arms 14A vertically arranged in two levels. Each of the upper and lower transfer arms 14A is configured to be movable up and down and rotatable along a horizontal direction. With this configuration, the second substrate transfer mechanism 14 transfers the substrates W between the transfer unit 10, the electroless plating units 11, the heating units 12 and the cooling unit 13 by the transfer arms 14A.

The conveyance unit 3 is a transfer mechanism located between the loading/unloading unit 1 and the processing unit 2 and serving to transfer the substrates W sheet by sheet. A first substrate transfer mechanism 9 for transferring the substrates W sheet by sheet is disposed in the conveyance unit 3. The substrate transfer mechanism 9 includes, for example, two transfer arms 9A vertically arranged in two levels and movable along a Y direction, and it performs a transfer of the substrates W between the loading/unloading unit 1 and the processing unit 2. Likewise, each transfer arm 9A is configured to be movable up and down and rotatable along a horizontal direction. With this configuration, the first substrate transfer mechanism 9 transfers the substrates W between the FOUPs F and the processing unit 2 by the transfer arms 9A.

The control unit 5 includes a process controller 51 having a microprocessor; a user interface 52 connected with the process controller 51; and a storage unit 53 for storing therein computer programs for regulating the operation of the semiconductor manufacturing apparatus in accordance with the present embodiment, and controls the processing unit 2, the conveyance unit 3, and so forth. The control unit 5 is on-line connected with a non-illustrated host computer and controls the semiconductor manufacturing apparatus based on instructions from the host computer. The user interface 52 is an interface including, for example, a key board, a display, and the like, and the storage unit 53 includes, for example, a CD-ROM, a hard disk, a nonvolatile memory or the like.

Now, the operation of the semiconductor manufacturing apparatus in accordance with the present embodiment will be explained. A substrate W to be processed is previously accommodated in a FOUP F. First, the first substrate transfer mechanism 9 takes the substrate W out of the FOUP F through the window 7A and transfers it to the transfer unit 10. Once the substrate W is transferred to the transfer unit 10, the second substrate transfer mechanism 14 transfers the substrate W from the transfer unit 10 to the hot plate of the heating unit 12 by using the transfer arm 14A.

The heating unit 12 heats (pre-bakes) the substrate W up to a preset temperature, to thereby eliminate organic materials attached on the surface of the substrate W. After the heating process, the second substrate transfer mechanism 14 delivers the substrate W from the heating unit 12 into the cooling unit 13. The cooling unit 13 cools the substrate W.

After the completion of the cooling process, the second substrate transfer mechanism 14 transfers the substrate W into the electroless plating unit 11 by using the transfer arm 14A. The electroless plating unit 11 performs an electroless plating process on a wiring formed on the surface of the substrate W or the like.

After the completion of the electroless plating process, the second substrate transfer mechanism 14 transfers the substrate W from the electroless plating unit 11 to the hot plate of the heating unit 12. The heating unit 12 performs a post-baking process on the substrate W to remove organic materials contained in a plated film (cap metal) formed by the electroless plating as well as to enhance adhesiveness between the plated film and the wiring or the like. After the completion of the post-baking process, the second substrate transfer mechanism 14 transfers the substrate W from the heating unit 12 into the cooling unit 13. The cooling unit 13 cools the substrate W again.

After the completion of the cooling process, the second substrate transfer mechanism 14 transfers the substrate W to the transfer unit 10. Then, the first substrate transfer mechanism 9 returns the substrate W mounted on the transfer unit 10 back into a preset position in the FOUP F by using the transfer arm 9A.

Afterwards, these series of processes are consecutively performed on a plurality of substrates. Further, it may be possible to previously process a dummy wafer at an initial stage and then to facilitate the stabilization of a processing state of each unit. As a result, reproducibility of the process can be improved.

Figure 2:
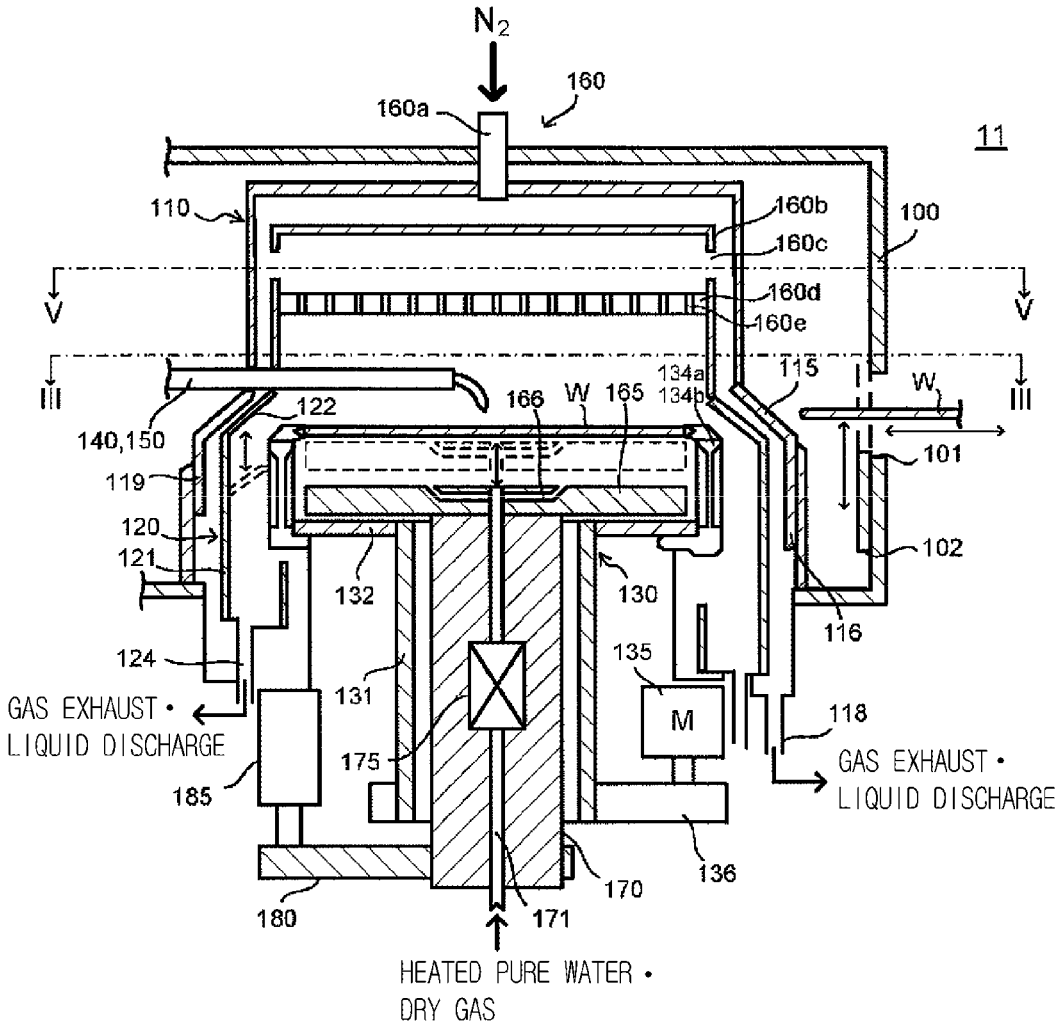
FIG. 2 sets forth a cross sectional view of an electroless plating unit of the semiconductor manufacturing apparatus in accordance with the embodiment of the present disclosure.

Subsequently, the electroless plating unit 11 of the semiconductor manufacturing apparatus in accordance with the present embodiment will be explained in detail in conjunction with FIGS. 2 to 4. As shown in FIG. 2, the electroless plating unit 11 (hereinafter, simply referred to as a "plating unit 11") includes an outer chamber 110, an inner chamber 120, a spin chuck 130, a first and a second fluid supply unit 140 and 150, a gas supply unit 160, a back plate 165.

The outer chamber 110 is a processing vessel installed inside a housing 100, for performing the plating process therein. The outer chamber 110 is formed in a cylinder shape to surround an accommodation position of the substrate W and is fixed on the bottom surface of the housing 100. Installed at a lateral side of the outer chamber 110 is a window 115 through which the substrate W is loaded and unloaded, and the window 115 is opened or closed by a shutter mechanism 116 (FIG. 2 shows a closed state). Further, an openable/closable shutter mechanism 19 for operating the first and second fluid supply units 140 and 150 is installed at a lateral side of the outer chamber 110 facing the window 115 (FIG. 2 shows a closed state). Moreover, a gas supply unit 160 (gas supply pipe 160*a*) is installed on the top surface of the outer chamber 110, and a drain unit 118 for exhausting a gas, a processing solution or the like is provided at a lower portion of the outer chamber 110.

The inner chamber 120 is a vessel for receiving therein the processing solution dispersed from the substrate W and forming therein a gas flow by rectifying a gas supplied from the gas supply unit 160. The inner chamber 120 formed in the substantially same shape (cylindrical shape) as the outer chamber 110 has a smaller size than the outer chamber 110, and is installed inside the outer chamber 110. The inner chamber 120 is disposed between the outer chamber 110 and the accommodation position of the substrate W, and it includes a drain unit 124 for discharging a gas or a liquid.

Gas inlet openings 160*c* are provided at a sidewall 160*b* of the inner chamber 120. Since the gas supply pipe 160*a* is installed at the outer chamber 110's top portion facing the top surface of the inner chamber 120, the gas supplied from the gas supply pipe 160*a* is guided from the top surface of the inner chamber 120 to the gas inlet openings 160*c* via the sidewall 160*b*. That is, the gas flow path through which the gas from the gas supply pipe 160*a* reaches the gas inlet opening 160*c* formed on the sidewall surface 160*b*, which does not face the gas supply pipe 160*a*, via the top surface of the inner chamber 120 functions as a gas conductance and forms a gas pressure gradient between the inside and the outside of the inner chamber 120.

A rectifying plate 160*d* is disposed inside the sidewall 160*b* of the inner chamber 120. The rectifying plate 160*d* is installed at the sidewall 160*b* to be located closer to the substrate W than to the gas inlet openings 160*c* in parallel with the substrate W. The rectifying plate 160*d* has a preset thickness and is provided with a plurality of rectifying holes 160*e* formed in its thickness direction. The rectifying holes 160*e* provided in the rectifying plate 160*d* function to rectify the gas introduced from the gas inlet openings 160*c* and then send the gas toward the substrate W. Further, the rectifying plate 160*d* also has a function of forming a gas pressure gradient between the region in which the substrate W is held and the outside of the inner chamber in cooperation with the gas inlet openings 160*c*.

Further, it may be possible to move the inner chamber 120 up and down inside the outer chamber 110 by using a non-illustrated elevating mechanism such as a gas cylinder or the like. In such case, an end portion 122 of the inner chamber 120 is moved up and down between a position (processing position) slightly higher than the accommodation position of the substrate W and a position (retreat position) lower than the processing position. Here, the processing position is a position where the electroless plating is performed on the substrate W, and the retreat position is a position where the loading/unloading of the substrate, cleaning of the substrate W or the like is performed.

The spin chuck 130 is a substrate fixing mechanism for holding the substrate W thereon in a substantially horizontal manner. The spin chuck 130 includes a rotary cylinder body 131; an annular rotary plate 132 horizontally extended from the upper end of the rotary cylinder body 131; supporting pins 134*a* installed at an outer peripheral end of the rotary plate 132 at a same distance, for supporting the outer periphery portion of the substrate W; and pressing pins 134*b* for pressing the outer peripheral surface of the substrate W. As illustrated in FIG. 3, the supporting pins 134*a* and the pressing pins 134*b* are arranged, for example, in sets of three along the circumferential direction. The supporting pins 134*a* are fixtures which support and fix the substrate W at the preset position, and the pressing pins 134*b* are pressing devices which press the substrate W downward. A motor 135 is installed at a lateral side of the rotary cylinder body 131, and an endless belt 136 is wound between a driving shaft of the motor 135 and the rotary cylinder body 131. That is, the rotary cylinder body 131 is rotated by the motor 135. The supporting pins 134*a* and the pressing pins 134*b* are rotated in the horizontal direction (planar direction of the substrate W), whereby the substrate W supported by them is also rotated.

The gas supply unit 160 supplies a nonreactive gas such as a nitrogen gas or the like (hereinafter, simply referred to as "gas") in the outer chamber 110 toward the substrate W. The nitrogen gas or clean air introduced through the gas inlet openings 160*c* and the rectifying plate 160*d* having the rectifying holes 160*e* is re-collected via the drain unit 118 or 124 installed at the lower end of the outer chamber 110.

The back plate 165 is installed between the holding position of the substrate W by the spin chuck 130 and the rotary plate 132, facing the bottom surface of the substrate W held on the spin chuck 130. The back plate 165 has a heater embedded therein and is connected with a shaft 170 which penetrates the center of axis of the rotary cylinder body 131. Provided in the back plate 165 is a flow path 166 which is opened at plural positions on the surface thereof, and a fluid supply path 171 is formed to penetrate through the flow path 166 and the center of axis of the shaft 170. A heat exchanger 175 is disposed in the fluid supply path 171. The heat exchanger 175 regulates a processing fluid such as pure water or a dry gas at a preset temperature. That is, the back plate 165 functions to supply the humidity-controlled processing fluid toward the bottom surface of the substrate W. An elevating mechanism 185 such as an air cylinder or the like is connected to a lower end portion of the shaft 170 via a coupling member 180. The back plate 165 is moved up and down between the substrate W held on the spin chuck 130 and the rotary plate 132 by the elevating mechanism 185 and the shaft 170.

Figure 3:
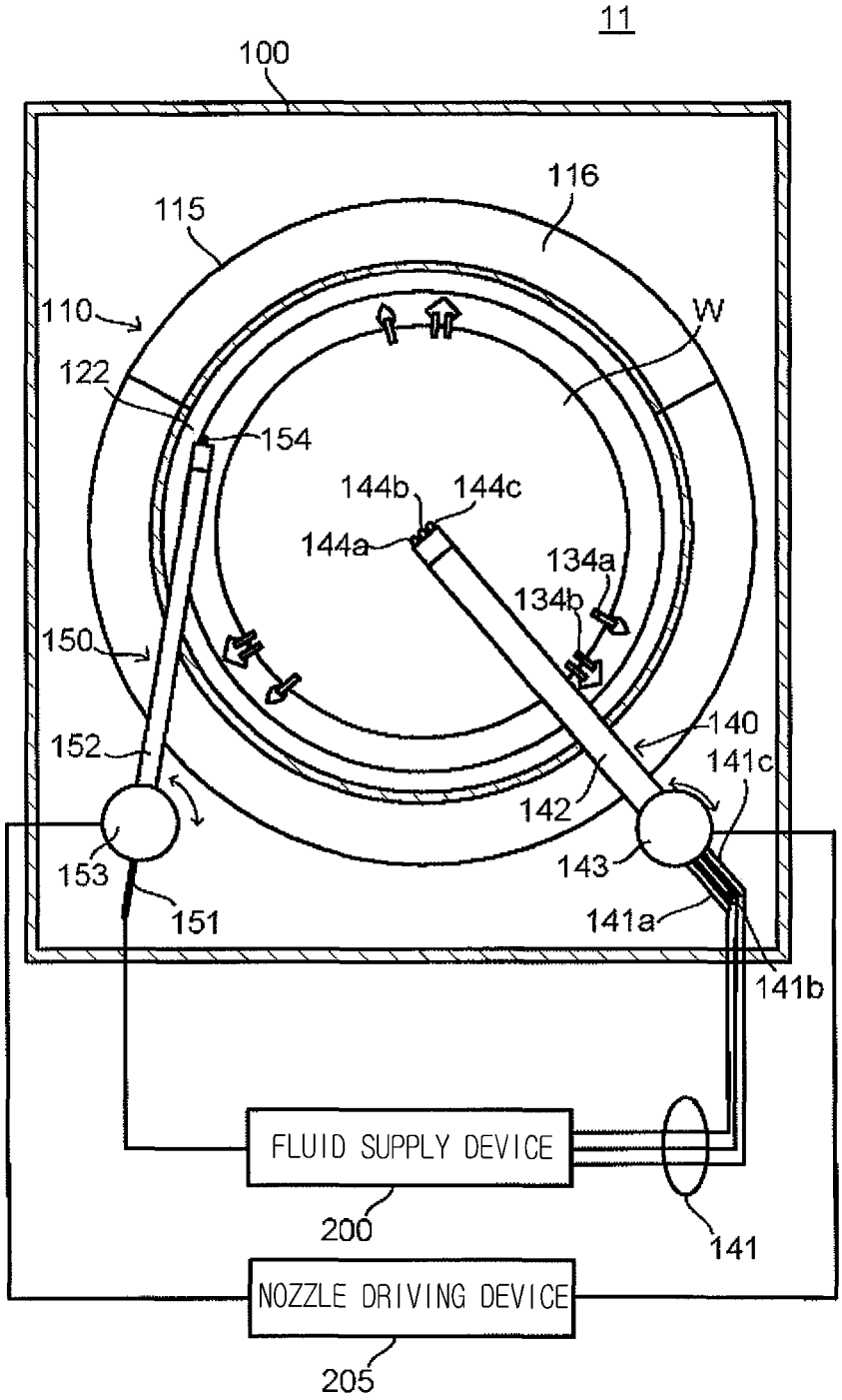
FIG. 3 presents a plane view of the electroless plating unit of the semiconductor manufacturing apparatus in accordance with the embodiment of the present disclosure.
Figure 4:
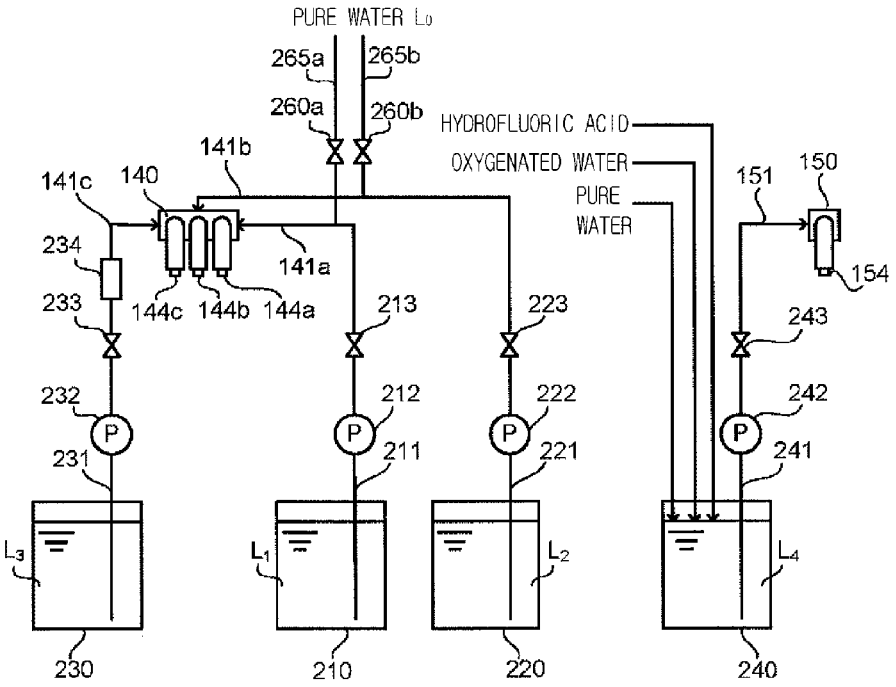
FIG. 4 depicts a configuration view of a fluid supply device of the semiconductor manufacturing apparatus in accordance with the embodiment of the present disclosure.

As shown in FIG. 3, the first and second fluid supply units 140 and 150 supply the processing solution onto the top surface of the substrate W held by the spin chuck 130. The first and second fluid supply units 140 and 150 have a fluid supply device 200 for storing therein a fluid such as the processing solution; and a nozzle driving device 205 for driving a supply nozzle. Each of the first and second fluid supply units 140 and 150 is installed inside the housing 100 so as to allow the outer chamber 110 to be interposed therebetween.

The first fluid supply unit 140 includes a first pipe 141 connected with the fluid supply device 200; a first arm 142 supporting the first pipe 141; a first rotation driving mechanism 143 for rotating the first arm 142 with respect to a basal end of the first arm 142 by using a stepping motor or the like disposed at that basal end of the first arm 142. The first fluid supply unit 140 has a function of supplying the processing fluid such as the electroless plating processing solution or the like. The first pipe 141 has pipes 141*a* to 141*c* for supplying three kinds of fluids individually, and these pipes 141*a* to 141*c* are respectively connected with nozzles 144*a* to 144*c* at the leading end portion of the first arm 142. In the pre-cleaning process, a processing solution and pure water are supplied from the nozzle 144*a*; in the post-cleaning process, a processing solution and pure water are supplied from the nozzle 144*b*; and in the plating process, a plating solution is supplied from the nozzle 144*c*.

Likewise, the second fluid supply unit 150 includes a second pipe 151 connected with the fluid supply device 200; a second arm 152 supporting the second pipe 151; and a second rotation driving mechanism 153 disposed at the basal end of the second arm 152, for rotating the second arm 152. The second pipe 151 is connected with a nozzle 154 at the leading end portion of the second arm 152. The second fluid supply unit 150 has a function of supplying a processing fluid for processing the outer periphery portion (periphery portion) of the substrate W. The first and second arms 142 and 152 are rotated above the substrate W held on the spin chuck 130 via the shutter mechanism 119 installed in the outer chamber 110.

Here, the fluid supply device 200 will be described in detail with reference to FIG. 4. The fluid supply device 200 supplies the processing fluid to the first and second fluid supply units 140 and 150. As illustrated in FIG. 4, the fluid supply device 200 includes a first tank 210, a second tank 220, a third tank 230 and a fourth tank 240.

The first tank 210 stores therein a pre-cleaning processing solution $L_1$ used for the pre-treatment of the electroless plating process of the substrate W. The second tank 220 stores therein a post-cleaning processing solution $L_2$ used for the post-treatment of the electroless plating process of the substrate W. The first and second tanks 210 and 220 include temperature control mechanisms (not shown) for controlling the temperatures of the processing solutions $L_1$ and $L_2$ at preset temperatures, and are connected with a pipe 211 coupled with the first pipe 141*a* and a pipe 221 coupled with the first pipe 141*b*, respectively. The pipes 211 and 221 are provided with pumps 212 and 222 and valves 213 and 223, respectively. The processing solutions $L_1$ and $L_2$ whose temperatures are controlled at the preset temperatures are supplied into the first pipes 141*a* and 141*b*, respectively. That is, by operating each of the pumps 212 and 222 and the valves 213 and 223, the processing solutions $L_1$ and $L_2$ are transported to the nozzles 144*a* and 144*b* via the first pipes 141*a* and 141*b*, respectively.

The third tank 230 stores therein a plating solution $L_3$ for use in processing the substrate W. The third tank 230 is connected with a pipe 231 coupled to the first pipe 141*c*. Installed on the pipe 231 are a pump 232, a valve 233 and a heater (e.g., a heat exchanger 234) for heating the plating solution $L_1$. That is, the temperature of the plating solution $L_3$ is controlled by the heater 234, and the plating solution $L_3$ is transported to the nozzle 144*c* via the first pipe 141*c* by the cooperation of the pump 232 and the valve 233. The pump 232 may function as a transporting mechanism, such as a pressurizing mechanism or a force-feed mechanism, for transporting the plating solution $L_3$.

The fourth tank 240 stores therein an outer periphery processing solution $L_4$ for use in processing the outer periphery portion of the substrate W. The fourth tank 240 is connected with a pipe 241 coupled to the second pipe 151. A pump 242 and a valve 243 are installed on the pipe 241. That is, the outer periphery processing solution $L_4$ is sent out into the nozzle 154 via the second pipe 151 by the cooperation of the pump 242 and the valve 243.

Further, a pipe for supplying, e.g., hydrofluoric acid, a pipe for supplying oxygenated water and a pipe for supplying pure water $L_0$ are also connected with the fourth tank 240. That is, the fourth tank 240 also functions to mix these solutions at a preset mixture ratio.

Further, pipes 265*a* and 265*b* for supplying pure water $L_0$ are connected with the first pipe 141*a* and 141*b*, respectively. A valve 260*a* is installed on the pipe 265*a*, and a valve 260*b* is installed on the pipe 265*b*. That is, the nozzles 144*a* and 144*b* are also capable of supplying the pure water $L_0$.

Figure 5:
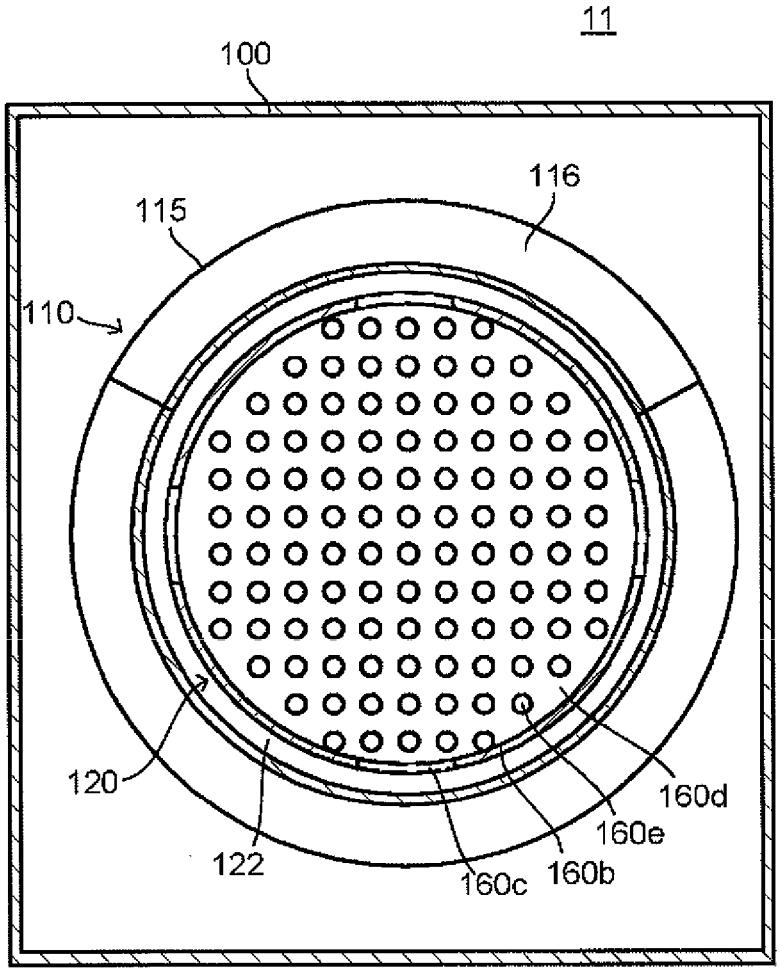
FIG. 5 offers a cross sectional view illustrating the configuration of a rectifying plate of the electroless plating unit shown in FIG. 2.

Here, the rectifying plate 160*d* will be described in detail with reference to FIG. 5. FIG. 5 is a cross sectional view illustrating the configuration of the rectifying plate 160*d* viewed from the top surface side of the plating unit 11 shown in FIG. 2. As shown in FIG. 5, the rectifying plate 160*d* conforming to the horizontal-directional cross section of the inner chamber 120 is provided inside the inner chamber 120, and the plurality of rectifying holes 160*e* are formed through the rectifying plate 160*d*. The rectifying holes 160*e* function to form a gas flow toward the substrate W held under the rectifying plate 160*d*. The size or the direction of each rectifying hole 160*e* is set so as to allow the plating process to be performed on the substrate W uniformly.

The gas inlet openings 160*c* are provided at the sidewall 160*b* of the inner chamber 120. The gas inlet openings 160*c* are equi-spaced in four directions, for example, and they function to introduce the gas provided from the gas supply unit 160 in a uniform manner. That is, the gas inlet openings 160*c* are formed at well-spaced positions in the plane direction of the rectifying plate 160*d* without being gathered at any particular position.

Figure 6:
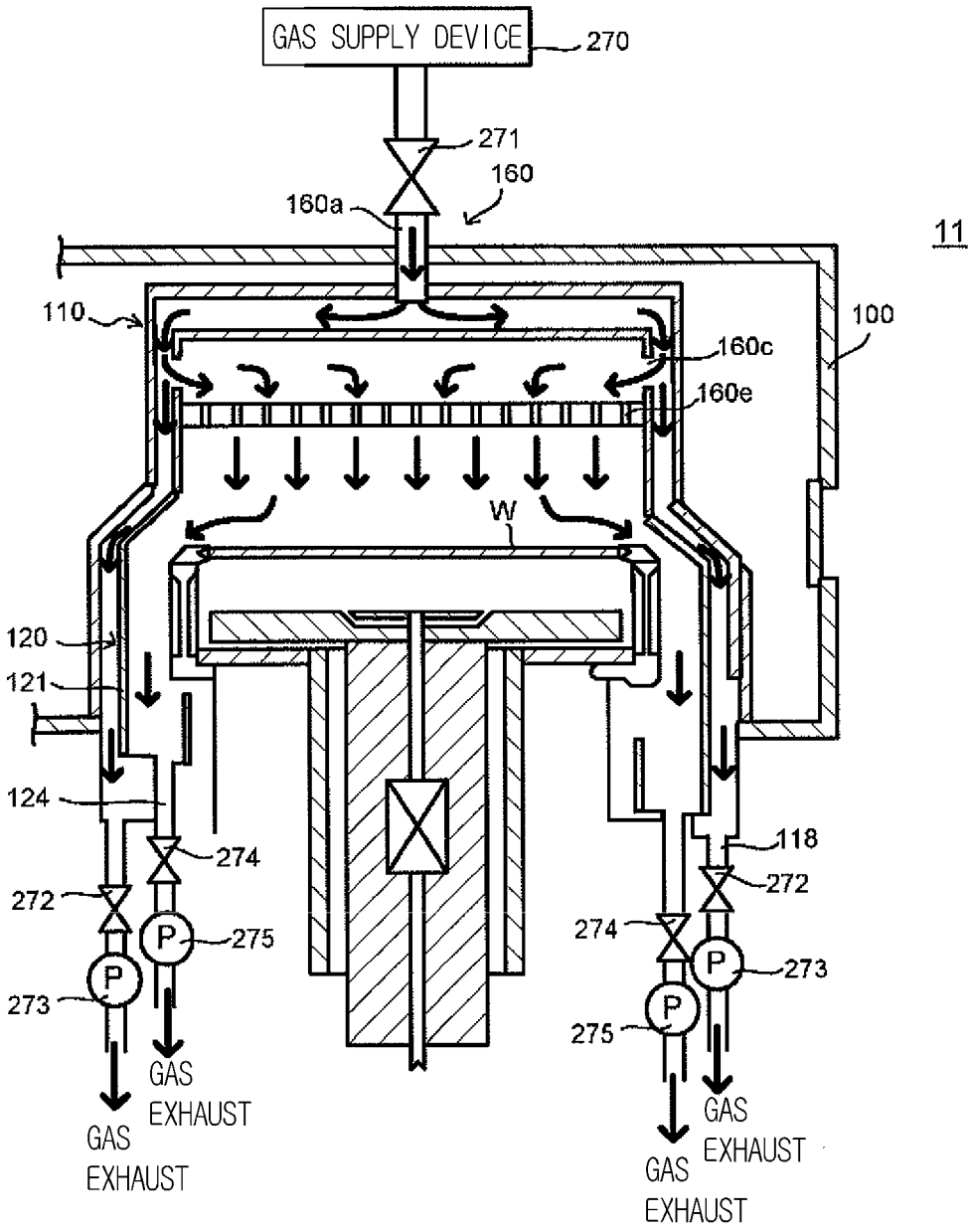
FIG. 6 shows only the configuration related to a gas supply unit of the plating unit 11 shown in FIG. 2.

Now, the gas supply unit 160 will be described in detail with reference to FIG. 6. FIG. 6 shows only the configuration related to the gas supply unit 160 in the plating unit 11 shown in FIG. 2. As illustrated in FIG. 6, the plating unit 11 in accordance with this embodiment includes a gas supply device 270 for generating a gas such as $N_2$ or the like and controlling the temperature of the gas; a valve 271 for controlling the amount of the gas, which is generated by the gas supply device 270, supplied into the outer chamber 110; valves 272 and pumps 273 for exhausting the gas flowing between the outer chamber 110 and the inner chamber 120 while controlling the exhaust amount thereof; and valves 274 and pumps 275 for exhausting the gas flowing inside the inner chamber 120 while controlling the exhaust amount thereof.

The gas supply device 270 generates a gas of a preset temperature. The gas generated by the gas supply device 270 serves as a heat transfer medium for transferring heat to the substrate W and also functions to exclude an oxidizing gas such as oxygen or the like from the vicinity of the surface of the substrate W. Accordingly, the gas generated by the gas supply device 270 may be desirably an oxidation suppressing gas, and it can be, for example, a nonreactive gas such as $N_2$ or the like. Further, the temperature of the gas generated by the gas supply device 270 is desirably set to be the same as a plating process temperature for the substrate W and it can be, for example, about 50° C. to 80° C. The following description is provided for the case that the gas supply device 270 generates $N_2$. One end of the gas supply pipe 160*a* is connected with the gas supply device 270 so that the generated gas is discharged into the supply pipe 160*a*.

The supply pipe 160*a* includes the valve 271. The valve 271 controls the supply of the gas generated by the gas supply device 270 and supply amount thereof based on an instruction from the process controller 51. The supply amount of the gas is determined based on the gas exhaust amounts by the valves 272 and 274 and the pumps 273 and 275 for a exhaust, the gas pressure inside the outer chamber 110, or the like, as will be described later. The other end of the supply pipe 160*a* is connected with the top surface of the outer chamber 110, and the gas supplied through the supply pipe 160*a* is introduced into the outer chamber 110.

The valves 272 and the pumps 273 are installed at the drain unit 118. The valves 272 and the pumps 273 exhaust the gas inside the outer chamber 110 based on an instruction from the process controller 51. As stated above, the gas exhaust amount from the outer chamber 110 is determined based on the gas pressure and the gas exhaust amount by the valves 272 and the pumps 273 and is controlled by the process controller 51. In the present embodiment, though the inside of the outer chamber 110 is maintained under the preset atmosphere by the cooperation of the valves 272 and the pumps 273 for exhausting the gas, it may be possible to dispose either the valves 272 or the pumps 273.

The valves 274 and the pumps 275 are installed at the drain unit 124. The valves 274 and the pumps 275 exhaust the gas inside the inner chamber 120 based on an instruction from the process controller 51. As stated above, the gas exhaust amount from the inner chamber 120 is determined based on the gas pressure and the gas exhaust amount by the valves 274 and the pumps 275 and is controlled by the process controller 51. In the present embodiment, though the inside of the inner chamber 120 is maintained under the preset atmosphere by the cooperation of the valves 274 and the pumps 275 for exhausting the gas, it may be possible to dispose either the valves 274 or the pumps 275.

As illustrated in FIG. 6, a part of the gas generated by the gas supply device 270 is introduced from the supply pipe 160*a* into the gas inlet openings 160*c* via the top surface and the sidewall 160*b* of the inner chamber 120 by the operation of the valve 271, the valves 272 and the pumps 273, and the valves 274 and the pumps 275. The flow path from the gas supply pipe 160*a* to the gas inlet openings 160*c* forms the conductance, as stated above. The gas introduced through the gas inlet openings 160*c* is then introduced into the rectifying holes 160*e* provided in the rectifying plate 160*d* and is uniformly injected toward the substrate W after rectified. The gas injected onto the substrate W flows on the surface of the substrate W toward the circumferential direction and is exhausted out by the drain unit 124 via the valves 274 and the pumps 275. Meanwhile, the residual gas not introduced into the gas inlet openings 160*c* flows between the outer chamber 110 and the inner chamber 120 and is exhausted by the drain unit 118 via the valves 272 and the pumps 273. The gas having passed through the rectifying holes 160*e* of the rectifying plate 160*d* becomes a gas flow flowing on the surface of the substrate W toward the circumferential direction. The gas flow excludes a reactive gas such as oxygen capable of functioning as an oxidizing agent from the vicinity of the surface of the substrate and also serves to transfer heat to the substrate W, thereby assisting the maintenance of the plating process temperature on the surface of the substrate W.

Figure 7:
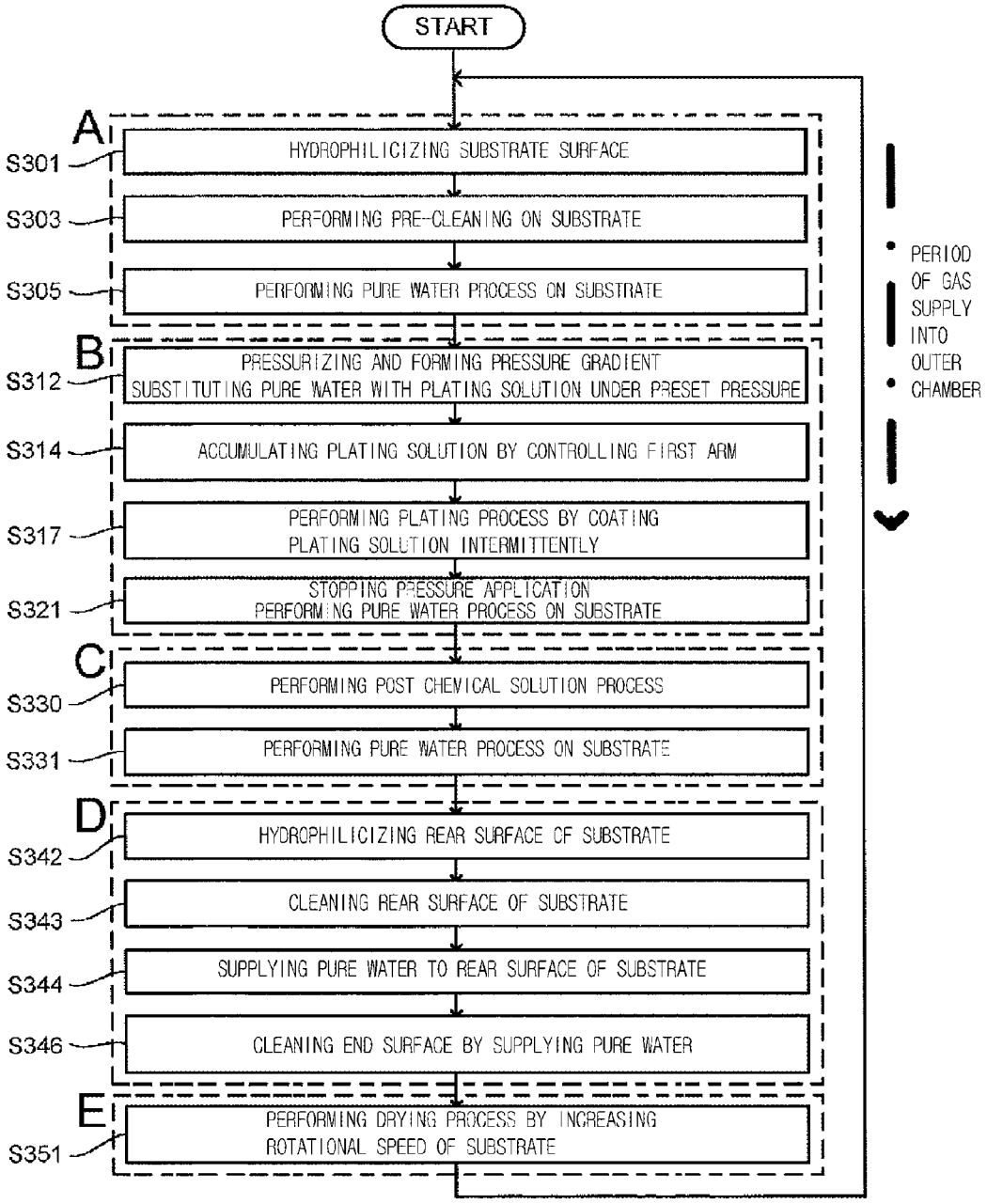
FIG. 7 provides a flowchart to describe an operation of the electroless plating unit in accordance with the embodiment of the present disclosure.
Figure 8:
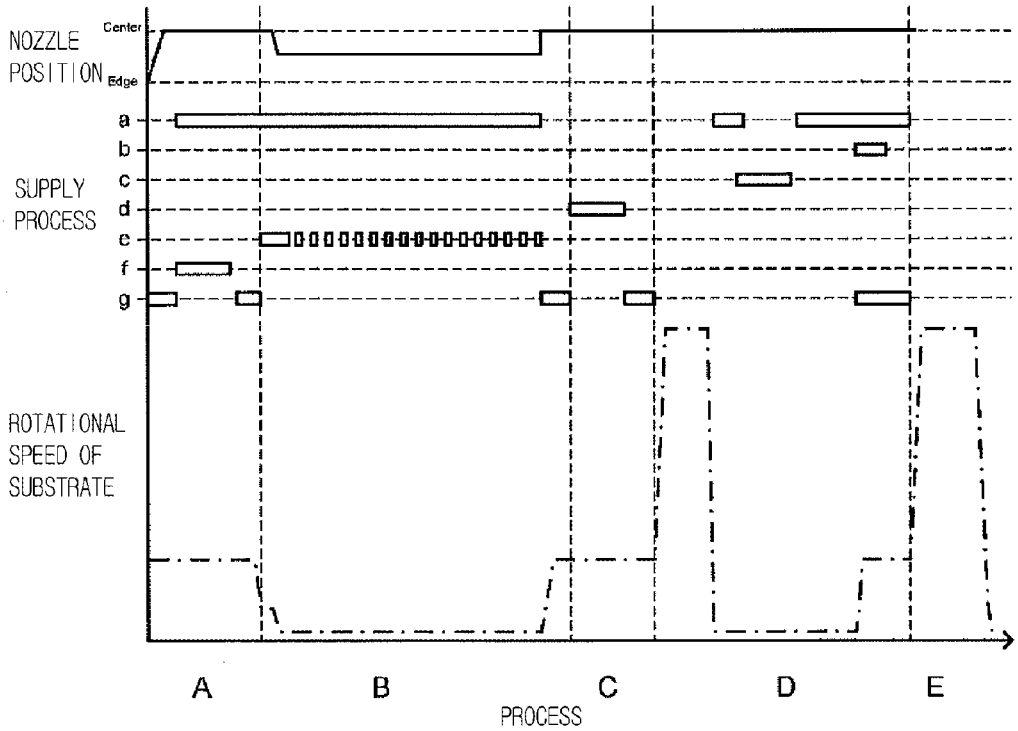
FIG. 8 sets forth a diagram for describing an entire process of the electroless plating unit in accordance with the embodiment of the present disclosure.

Now, the operation of the electroless plating unit 11 in accordance with the present embodiment will be described with reference to FIGS. 1 to 8. FIG. 7 provides a flowchart to describe the operation of the electroless plating unit 11 in accordance with the present embodiment, especially, a plating process operation thereof. FIG. 8 illustrates an entire process sequence of the electroless plating unit 11. As shown in FIG. 7, the plating unit 11 in accordance with the present embodiment performs five processing steps including a pre-cleaning process ("A" in the figure), a plating process ("B" in the figure), a post-cleaning process ("C" in the figure), a rear surface/end surface cleaning process ("D" in the figure) and a drying process ("E" in the figure). Further, as shown in FIG. 8, the plating unit 11 performs seven supply processes of processing liquids including a rear surface pure water supply a for supplying heated pure water to the rear surface of the substrate; an end surface cleaning b for cleaning the end surface of the substrate; a rear surface cleaning c for cleaning the rear surface of the substrate; a post-cleaning d for cleaning the substrate after a plating process; the plating process e; a pre-cleaning f for cleaning the substrate prior to the plating process; and a pure water supply g for controlling the hydrophilicity of the substrate W.

The first substrate transfer mechanism 9 takes substrate W sheet by sheet from the FOUP F of the loading/unloading unit 1 and loads each substrate W into the transfer unit 10 of the processing unit 2. Once the substrate W is loaded, the second substrate transfer mechanism 14 transfers the substrate W into the heating unit 12 and the cooling unit 13 in which the substrate W is processed by a heat treatment therein. Upon the completion of the heat treatment, the second substrate transfer mechanism 14 transfers the substrate W into the electroless plating unit 11.

First, the process controller 51 carries out the pre-cleaning process A. The pre-cleaning process A includes a hydrophilicizing process, a pre-cleaning process, and a pure water process.

The process controller 51 rotates the substrate W held on the spin chuck 130 by driving the motor 135. If the spin chuck 130 is rotated, the process controller 51 instructs the gas supply device 270 to generate a nonreactive gas (e.g., a $N_2$ gas) of a preset temperature and also instructs the nozzle driving device 205 to drive the first fluid supply unit 140. If the gas supply device 270 generates the gas of the preset temperature, the process controller 51 operates the valve 271, the valve 272 and the pump 273 to form a gas atmosphere of a preset pressure within the outer chamber 110. Subsequently, the process controller 51 operates the valve 274 and the pump 275, and generates gas flows from the inlet openings 160*c* toward the rectifying plate 160*d* inside the inner chamber 120; from the rectifying plate 160*d* toward the surface of the substrate W; and from the surface of the substrate toward the periphery portion (edge portion) of the substrate W, whereby a pressure gradient is formed between them.

The nozzle driving device 205 moves the first arm 142 to a preset position on the substrate W (e.g., a position at which the nozzle 144*a* is located at the center of the substrate W) by operating the first rotation driving mechanism 143. Further, the nozzle driving device 205 also moves the second arm 152 to a periphery portion of the substrate W by operating the second rotary driving mechanism 153. When the two arms reach their preset positions, the process controller 51 instructs the fluid supply device 200 to perform the hydrophilicizing process (S301). Then, the fluid supply device 200 supplies a preset amount of pure water $L_0$ into the nozzle 144*a* by opening the valve 260*a* (supply process g in FIG. 7). At this time, the nozzle 144*a* is located above the substrate W by, e.g., about 0.1 to 20 mm. Likewise, the fluid supply unit 200 supplies the processing liquid $L_4$ into the nozzle 154 by opening the valve 243. In this process, as the processing liquid $L_1$, one capable of obtaining a hydrophilicizing effect different from that of the pure water $L_0$ is employed. This hydrophilicizing process prevents the pre-cleaning solution to be supplied in the subsequent pre-cleaning process from splashing off the surface of the substrate W and also suppresses the plating solution from being dropped off the surface of the substrate W.

Subsequently, the process controller 51 instructs the fluid supply device 200 to perform the pre-cleaning process (supply process f in FIG. 8) and the heated pure water supply to rear surface (supply process a in FIG. 8). The fluid supply device 200 stops the supply of the pure water $L_0$ by closing the valve 260*a* and stops the supply of the processing solution $L_4$ by closing the valve 243, and supplies the pre-cleaning processing solution $L_1$ into the nozzle 144*a* by driving the pump 212 and the valve 213 (S303). Here, since the nozzle 144*a* is moved to the almost central position of the substrate W, the nozzle 144*a* becomes to supply the pre-cleaning solution $L_1$ toward the almost central portion of the substrate W. Since organic acid or the like is used as the pre-cleaning processing solution, it can eliminate copper oxide from copper wiring without causing galvanic corrosion, thereby increasing nucleation density in the plating process.

Thereafter, the fluid supply device 200 supplies the pure water to the fluid supply path 171. The heat exchanger 175 controls the temperature of the pure water sent into the fluid supply path 171 and supplies the temperature-controlled pure water to the bottom surface of the substrate W via the flow path 166 provided in the back plate 165, whereby the temperature of the substrate W is maintained at a temperature adequate for the plating process. Further, almost the same effect as described can be obtained even if starting the supply of the pure water into the fluid supply path 171 simultaneously with the above-described step S303.

Upon the completion of the pre-cleaning process, the process controller 51 instructs the fluid supply device 200 to perform the pure water process (supply process g in FIG. 8) (S305). The fluid supply device 200 stops the supply of the pre-cleaning processing solution $L_1$ by operating the pump 212 and the valve 213, and sends a certain amount of pure water $L_0$ into the nozzle 144*a* by opening the valve 260*a*. Then, by the supply of the pure water $L_0$ from the nozzle 144*a*, the pre-cleaning processing solution is substituted with the pure water. Through this pure water process, a generation of a process error due to the mixing of the acid pre-cleaning processing solution $L_1$ with the alkaline plating processing solution can be prevented.

After the pre-cleaning process A, the process controller 51 performs the plating process B. The plating process B includes a plating solution substitution process, a plating solution accumulation process, a plating solution process, and a pure water process.

After making the instruction to generate the gas supplied into the outer chamber 110, the process controller 51 monitors a gas pressure inside the outer chamber 110 (or inside the outer chamber 110 and the inner chamber 120). If the gas pressure reaches the preset pressure, the process controller 51 instructs the fluid supply device 200 and the nozzle driving device 205 to perform the plating solution substitution process (supply process e in FIG. 8). The fluid supply device 200 stops the supply of the pure water $L_0$ by closing the valve 260*a*, and supplies the plating solution $L_3$ into the nozzle 144*c* by operating the pump 232 and the valve 233. Meanwhile, the nozzle driving device 205 operates the first rotation driving mechanism 143 to thereby rotate the first arm 142 such that the nozzle 144*c* is moved (scanned) from the central portion of the substrate W to the periphery portion thereof and then back to the central portion again (S312). In the plating solution substitution process, the plating solution supply nozzle is moved from the central portion of the substrate W to the periphery portion thereof and then back to the central portion, and the substrate W is rotated at a relatively high rotational speed. By this operation, the plating solution $L_3$ is diffused onto the substrate W, so that it becomes possible to rapidly substitute the pure water on the surface of the substrate W with the plating solution.

Upon the completion of the plating solution substitution process, the process controller 51 reduces the rotational speed of the substrate W held on the spin chuck 130, and instructs the fluid supply device 200 and the nozzle driving device 205 to perform the plating solution accumulation process. The fluid supply device 20 keeps on supplying the plating solution $L_3$, and the nozzle driving device 205 operates the first rotation driving mechanism 143, whereby the nozzle 144*c* is slowly moved from the central portion of the substrate W toward the periphery portion thereof (S314). The surface of the substrate W treated by the plating solution substitution process is covered with a sufficient amount of plating solution $L_3$. Further, when the nozzle 144*c* approaches close to the vicinity of the periphery portion of the substrate W, the process controller 51 further reduces the rotational speed of the substrate W.

Subsequently, the process controller 51 instructs the fluid supply device 200 and the nozzle driving device 205 to perform the plating process. The nozzle driving device 205 operates the first rotation driving mechanism 143 to thereby rotate the first arm 142 so as to locate the nozzle 144*c* at an almost midway position between the central portion and the periphery portion of the substrate W.

Then, the fluid supply device 200 supplies the plating solution $L_3$ into the nozzle 144*c* discontinuously or intermittently by operating the pump 232 and the valve 233 (S317). That is, as illustrated in FIG. 7, the nozzle is located at a preset position and the plating solution is supplied discontinuously or intermittently. Since the substrate W is being rotated, the plating solution $L_3$ can be widely diffused onto the entire region of the substrate W even if it is supplied discontinuously (intermittently). Further, the processes of the steps S312, S314 and S317 may be performed repetitively. After a lapse of a predetermined time period after the supply of the plating solution $L_3$ is begun, the fluid supply device 200 stops the supply of the plating solution $L_3$, and the process controller 51 stops the supply of the heated pure water to the rear surface of the substrate W. Besides, the process controller 51 stops the operations of the valve 271, the valve 272, the pump 273, the valve 274 and the pump 275, thereby stopping the gas flow. At this time, it may be also possible that the process controller 51 stops the operation of the gas supply device 270.

After the application of pressure inside the outer chamber by the gas supply device 270 is stopped, the process controller 51 instructs the fluid supply device 200 and the nozzle driving device 205 to perform the pure water process (supply process g in FIG. 8). The process controller 51 increases the rotational speed of the substrate W held on the spin chuck 130, and the nozzle driving device 205 operates the first rotation driving mechanism 143 to thereby rotate the first arm 142 so as to locate the nozzle 144*c* at the central portion of the substrate W. Thereafter, the fluid supply device 200 supplies the pure water $L_0$ by opening the valve 260*a* (S321). In this way, the plating solution left on the surface of the substrate W is eliminated so that the plating solution can be prevented from being mixed with a post-processing solution.

After the plating process B, the process controller 51 conducts the post-cleaning process C. The post-cleaning process C includes a post chemical solution treatment and a pure water process.

The process controller 51 instructs the fluid supply device 200 to perform the post chemical solution treatment (supply process d in FIG. 8). The fluid supply device 200 stops the supply of the pure water $L_0$ by closing the valve 260*a*, and supplies the post-cleaning processing solution $L_2$ into the nozzle 144*b* by operating the pump 222 and the valve 223 (S330). The post-cleaning processing solution $L_2$ functions to remove residues on the surface of the substrate W or an abnormally precipitated plated film.

After the post chemical solution treatment, the process controller 51 instructs the fluid supply device 200 to perform the pure water process (supply process g in FIG. 8). The fluid supply device 200 stops the supply of the post-cleaning processing solution $L_2$ by operating the pump 222 and the valve 223, and supplies the pure water $L_0$ by opening the valve 260*b* (S331).

After the post-cleaning process C, the process controller 51 performs the rear surface/end surface cleaning process D. The rear surface/end surface cleaning process D includes a liquid removing process, a rear surface cleaning process and an end surface cleaning process.

The process controller 51 instructs the fluid supply device 200 to perform the liquid removing process. The fluid supply device 200 stops the supply of the pure water $L_0$, by closing the valve 260*b*, and the process controller 51 increases the rotational speed of the substrate W held on the spin chuck 130. This process aims at removing the liquid on the surface of the substrate W by drying the surface of the substrate W.

After the completion of the liquid removing process, the process controller 51 instructs the fluid supply device 200 to perform the rear surface cleaning process. First, the process controller 51 decreases the rotational speed of the substrate W held on the spin chuck 130. Thereafter, the fluid supply device 200 supplies pure water into the fluid supply path 171 (supply process a in FIG. 8). The heat exchanger 175 controls the temperature of the pure water sent to the fluid supply path 171 and supplies the temperature-controlled pure water to the rear surface of the substrate W via a flow path provided in the back plate 165 (S342). The pure water functions to hydrophilicize the rear surface side of the substrate W. Subsequently, the fluid supply device 200 stops the supply of the pure water into the fluid supply path 171, and instead supplies a rear surface cleaning solution into the fluid supply path 171 (S343). The rear surface cleaning solution functions to wash away and remove residues on the rear surface side of the substrate W in the plating process (supply process c in FIG. 8).

Thereafter, the process controller 51 instructs the fluid supply device 20 and the nozzle driving device 205 to perform the end surface cleaning process. The fluid supply device 200 stops the supply of the rear surface cleaning solution into the rear surface of the substrate W and instead supplies pure water, the temperature of which is controlled by the heat exchanger 175, into the fluid supply path 171 (S344) (supply process a in FIG. 8).

Subsequently, the nozzle driving device 205 rotates the second arm 152 so as to locate the nozzle 154 at an edge portion of the substrate W by means of driving the second rotation driving mechanism 153, and the process controller 51 increases the rotational speed of the substrate W up to about 150 to 300 rpm. Likewise, the nozzle driving device 205 rotates the first arm 142 so as to locate the nozzle 144*b* at the central portion of the substrate W by means of operating the first rotation driving mechanism 143. The fluid supply device 200 supplies the pure water $L_0$ into the nozzle 144*b* by opening the valve 260*b*, and supplies the outer periphery processing solution $L_4$ into the nozzle 154 by operating the pump 242 and the nozzle 243 (supply processes a and g in FIG. 8). That is, in this state, the pure water $L_0$ and the outer periphery processing solution $L_4$ are supplied to the central portion and the edge portion of the substrate W, respectively, while the temperature-controlled pure water is supplied to the rear surface of the substrate W (S346).

After the rear surface/end surface cleaning process D, the process controller 51 performs the drying process E. The drying process E includes a drying step.

The process controller 51 instructs the fluid supply device 200 and the nozzle driving device 205 to perform the drying step. The fluid supply device 200 stops the supply of all the processing solutions, and the nozzle driving device 205 retreats the first arm 142 and the second arm 152 from above the substrate W. Further, the process controller 51 increases the rotational speed of the substrate W up to about 800 to 1000 rpm to thereby dry the substrate W (S351). After the completion of the drying step, the process controller 51 stops the rotation of the substrate W.

After the plating process is completed, the transfer arm 14A of the second substrate transfer mechanism 14 takes out the substrate W from the spin chuck 130 via the window 115.

Figure 9:
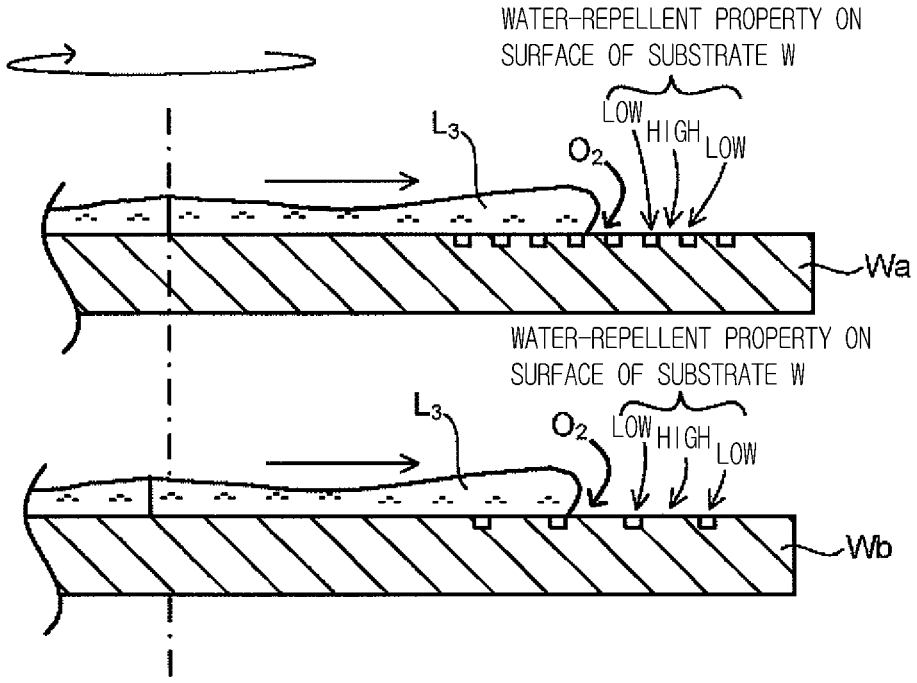
FIG. 9 presents a schematic diagram illustrating a state in which a plating solution flowing on a substrate accepts oxygen.

Here, the gas supply by the gas supply device 270 and the formation of the gas atmosphere inside the inner chamber 120 will be described in detail with reference to FIG. 9. FIG. 9 is a schematic diagram illustrating a state in which the plating solution flowing on the substrate accepts oxygen.

As stated above, in the plating process of the substrate W, the plating processing solution is coated on the substrate W while the substrate is being rotated. While the plating processing solution $L_3$ is flowing from the nozzle 144*c* to the processing surface of the substrate W, the plating processing solution $L_3$ is exposed to the atmosphere inside the outer chamber 110. At this time, if the inside of the outer chamber 110 is under a typical atmospheric atmosphere, it is likely that the plating processing solution $L_3$ accepts oxygen from the air until the plating solution $L_3$ reaches the processing surface of the substrate W.

Further, after arriving at the surface of the substrate W, the plating solution $L_3$ is flown toward the circumferential direction of the substrate W by the rotation thereof and is spread uniformly over the entire substrate surface. At this time, in case that the surface material of the substrate W is, for example, an interlayer insulating film or the like, it is known that the plating processing solution $L_3$ is more likely to accept the oxygen from the air while it is flowing on the surface of the substrate W because the water-repellent property of the insulating film itself is higher than that of a Cu pattern or the like. This fact implies that the sparseness or denseness of the Cu pattern formed on the interlayer insulating film affects the amount of oxygen introduced into the plating solution $L_3$ (the amount of oxygen dissolved in the plating solution $L_3$) (FIG. 9). The dissolved oxygen in the plating solution deteriorates the growth of the plating.

In the plating unit 11 in accordance with the present embodiment, however, since the nonreactive gas atmosphere is formed inside of the outer chamber 110 by injecting the nonreactive gas toward the surface of the substrate W, the plating processing solution $L_3$ can be suppressed from accepting the oxygen until it reaches the processing surface of the substrate W. Likewise, it can be also suppressed that the plating processing solution $L_3$ flowing on the surface of the substrate W toward the circumferential direction accepts the oxygen in the atmosphere due to the water-repellent property of the substrate surface (especially, due to the sparseness or denseness of the Cu pattern on the processing surface of the substrate on which the interlayer insulating film is formed). As a result, the amount of the dissolved oxygen in the plating solution $L_3$ can be reduced, and uniform plating process can be implemented.

As another factor which impedes the uniform plating process, the temperature decrease of the substrate W and the plating processing solution $L_3$ can be considered. A plating growth rate by the plating process tends to be affected by a temperature change of the plating processing solution or the substrate W. Even in the present embodiment, though the temperature of the plating processing solution $L_3$ is adjusted by the heater 234, the temperature of the plating processing solution $L_3$ discharged from the nozzle 144*c* is decreased until it reaches the substrate W. For example, in case that the plating process is set to be performed at about 50 to 80° C. and the inside of the outer chamber 110 is set to be under a typical room temperature atmosphere (about 25° C. or thereabout), the temperature decrease of the plating processing solution $L_3$ begins immediately after it is discharged out of the nozzle 144*c*. In the plating process in accordance with the present embodiment, since the plating processing solution $L_3$ is spread onto the entire surface of the substrate W uniformly by rotating the substrate W, the temperature decrease of the substrate becomes conspicuous at its edge region. Though a method of heating the substrate W itself or the like may be employed to suppress this phenomenon, it is generally difficult to heat the processing surface of the substrate W directly, and even if such method is employed, the temperature decrease of the plating processing solution $L_3$ itself cannot be prevented.

In this regard, in the plating unit 11 in accordance with the present embodiment, the temperature-controlled nonreactive gas is discharged toward the substrate W from a discharge unit facing the processing surface of the substrate W. If the temperature of the nonreactive gas generated by the gas supply device 270 is set to be equal to (or slightly higher than) the preset plating process temperature, the temperature decrease of the processing surface side of the substrate W can be prevented, and the temperature decrease of the plating processing solution $L_3$ itself coated on the substrate W can also be suppressed.

That is, in the plating unit 11 in accordance with the present embodiment, since the inside of the outer chamber 110 is maintained under the positive pressure condition and under the nonreactive gas atmosphere controlled at the plating process temperature during the plating process (or during a period after the substrate W is loaded into the outer chamber 110 till the end of the plating process), the oxygen or the like can be prevented from being dissolved in the plating processing solution $L_3$, and the temperature decrease of the plating processing solution $L_3$ and the substrate W can be suppressed. As a result, uniform plating process can be implemented. Moreover, though the suppression of the dissolution of the oxygen in the plating processing solution and the temperature control are described to be both achieved by the gas supply in the present embodiment, it is possible to obtain one of the two effects. For example, if the gas supply device 270 supplies air controlled to a certain temperature instead of the nonreactive gas, the effect of preventing the temperature decrease of the plating processing solution $L_3$ and the substrate W can be expected to be good, though the effect of suppressing the oxygen dissolution in the plating processing solution $L_3$ is weak.

Here, experiment examples in which the inside of the outer chamber 110 is set under the atmospheric atmosphere and under the nonreactive gas ($N_2$ gas) atmosphere will be explained with reference to Table 1. Table 1 shows a variation of a measurement of plating rate for each of the atmospheric atmosphere and the nitrogen gas atmosphere.

Plating processes were conducted on two Cu wiring patterns under a typical atmospheric atmosphere (oxygen concentration of about 20%) and a $N_2$ gas atmosphere (oxygen concentration less than about 2%) respectively, and plating rates were measured in respective cases. Here, the term "plating rate" implies a ratio of a pattern on which the plating process was successfully performed to an entire pattern. The widths of the Cu wiring patterns were set to be about 100 nm, and the states of the plating processes were investigated at a wafer center portion and a wafer edge portion for each of the two cases where the gap between the Cu wiring patterns was set to be about 100 nm and about 300 nm.

TABLE 1

| | | Atmosphere | | | |
|---|---|---|---|---|---|
| | | Air ($O_2$ = 20%) | | $N_2$ ($O_2$ < 2%) | |
| | | Size | | | |
| | | 100 nm:100 nm | 100 nm:300 nm | 100 nm:100 nm | 100 nm:300 nm |
| Plating rate | Wafer center | 100% | 0% | 100% | 95% |
| | Wafer edge | 50% | 0% | 100% | 95% |
| Plating state | | Thin at the edge | Mostly uncoated | Good | Good |

As stated above, the interlayer insulating film of the substrate or the like has a higher water-repellent property than the surface of Cu. Accordingly, as the gap between the patterns relatively gets larger, the plating rate tends to be reduced. As shown in FIG. 9, it is supposed that the longer a substrate surface region having a high repellent-property, the more the plating processing solution accepts oxygen from the atmosphere in the vicinity of the interface with the substrate surface while the plating processing solution is flowing on the substrate. Accordingly, a larger pattern gap is deemed to be a worse condition for a film formation. As can be seen from Table 1, in the atmospheric atmosphere, plating rarely grew in case of the pattern with the gap of about 300 nm, and only 50% of the entire plating growth was obtained at the substrate edge portion even in case of the pattern with the gap of about 100 nm. Meanwhile, in the $N_2$ atmosphere, a fine plating rate as much as 90% or greater could be obtained regardless of the pattern gap. That is, in the $N_2$ atmosphere, a fine plated film can be obtained even in case the pattern gap is large and the condition is unfavorable.

In accordance with the electroless plating unit of the embodiment shown in FIGS. 1 to 4, by setting the inside of the outer chamber to be under the temperature-controlled gas atmosphere during the plating process (and pre-steps thereof), the temperature decrease of the plating processing solution and the substrate W can be prevented. Furthermore, since the inside of the outer chamber was set to be under the nonreactive gas atmosphere by the electroless plating unit, the oxygen (or a gas functioning as an oxidizing agent) in the air can be prevented from dissolving into the plating solution $L_3$. As a result, uniform plating process can be carried out.

Figure 10:
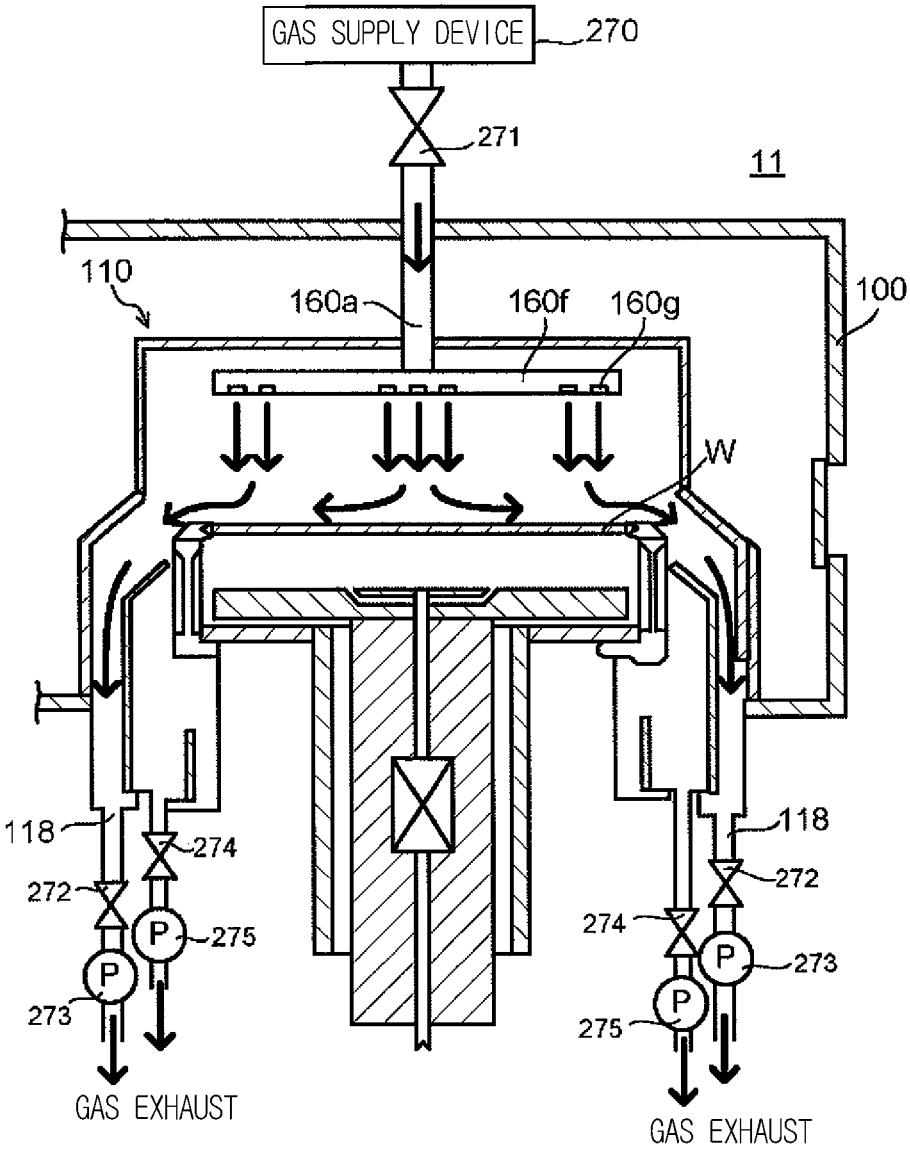
FIG. 10 depicts a diagram illustrating a modification example of the plating unit 11 shown in FIG. 6.

Now, a modification example of the plating unit in accordance with the embodiment will be explained. FIG. 10 illustrates the modification example of the electroless plating unit 11 shown in FIGS. 2 and 6. In the modification example of FIG. 10, since only the shapes of the inner chamber 120 and the rectifying plate **160*d* are changed from the plating unit of the present embodiment shown in FIG. 6**, like parts will be assigned like reference numerals and redundant description thereof will be omitted.

In this modification example, unlike the inner chamber 120 shown in FIG. 6 in which the gas flow path is formed by forming the airtight space, an inner chamber only functions to collect the processing solution dispersed from the substrate W. That is, the gas supply pipe **160*a* is directly connected with a shower head 160*f* provided with a number of rectifying holes 160*g*. The shower head 160*f* is disposed at a position facing the held substrate W. In the modification example of FIG. 10, the shower head 160*f*** provides a conductance to a gas flow and functions to rectify the gas flow toward the substrate W. In this modification example, a gas flow toward the substrate W can be formed with the simple structure.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure. Further, various disclosures can be conceived by combining a plurality of components described in the present embodiment appropriately. For example, some of the components described in the embodiment can be omitted, and components in different embodiments can be appropriately combined.

INDUSTRIAL APPLICABILITY

The present disclosure has many advantages when it is employed in the field of semiconductor manufacture.

What is claimed is:

1. A method for forming a cap metal on a processing surface of a substrate provided with two or more regions having different water-repellent properties, the method comprising:

holding the substrate horizontally by a rotatable holding mechanism installed in an inner chamber covered by an outer chamber;

supplying a nonreactive gas which has a temperature equal to or higher than a preset plating process temperature into the outer chamber via a gas supply hole provided in a top surface of the outer chamber;

forming a pressure gradient between the inner chamber and the outer chamber; and supplying a plating solution to a preset position on the processing surface of the substrate so as to form the cap metal on at least one of the regions, wherein the nonreactive gas is supplied onto the processing surface of the substrate and flows on the processing surface of the substrate, and transfers heat to the substrate, thereby suppressing the temperature decrease of the plating solution flowing on the processing surface of the substrate, and in the pressure gradient forming step, the nonreactive gas is uniformly introduced from the outer chamber into the inner chamber through a plurality of gas inlet openings provided at a sidewall of the inner chamber and spaced apart at equal distances, and is uniformly injected onto the processing surface of the substrate through a rectifying plate disposed above the processing surface of the substrate and below the plurality of gas inlet openings inside the inner chamber.

2. The method of claim 1, wherein the at least one of the regions on which the cap metal is formed by the plating solution supplying step is a copper pattern.

3. The method of claim 1, wherein in the pressure gradient forming step, a flow of the nonreactive gas on the substrate toward a circumferential direction thereof is generated by adjusting a gas exhaust amount by means of controlling a gas exhaust pump and a valve independently connected with the outer chamber or the inner chamber.

* * * * *

UNITED STATES PATENT AND TRADEMARK OFFICE

CERTIFICATE OF CORRECTION

PATENT NO. : 8,999,432 B2
APPLICATION NO. : 12/405468
DATED : April 7, 2015
INVENTOR(S) : Takashi Tanaka et al.

It is certified that error appears in the above-identified patent and that said Letters Patent is hereby corrected as shown below:

In the specification,

Column 8, line 51, please replace "$L_1$" with -- $L_3$ --

Column 11, line 56, please replace "$L_1$" with -- $L_4$ --

Signed and Sealed this
Twenty-ninth Day of September, 2015

Michelle K. Lee

Michelle K. Lee
*Director of the United States Patent and Trademark Office*